US010306370B2

(12) United States Patent
Hyde

(10) Patent No.: US 10,306,370 B2
(45) Date of Patent: May 28, 2019

(54) DUAL COIL ELECTRODYNAMIC TRANSDUCER WITH CHANNELS FOR VOICE COIL COOLING

(71) Applicant: Harman International Industries, Incorporated, Stamford, CT (US)

(72) Inventor: Ralph E. Hyde, Santa Clara, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 20 days.

(21) Appl. No.: 15/405,973

(22) Filed: Jan. 13, 2017

(65) Prior Publication Data

US 2018/0206040 A1 Jul. 19, 2018

(51) Int. Cl.
*H04R 9/02* (2006.01)
*H04R 9/06* (2006.01)

(52) U.S. Cl.
CPC ..... *H04R 9/063* (2013.01); *H04R 9/022* (2013.01)

(58) Field of Classification Search
CPC ..... H04R 9/063; H04R 9/022; H04R 9/043; H04R 9/06; H04R 9/025; H04R 9/045; H04R 2400/07; H04R 2400/11; H04R 1/02
USPC ..... 381/177, 396, 397
See application file for complete search history.

(56) References Cited

U.S. PATENT DOCUMENTS

| | | | | |
|---|---|---|---|---|
| 5,042,072 | A | 8/1991 | Button | |
| 5,909,015 | A * | 6/1999 | Yamamoto | H04R 9/022 181/156 |
| 8,014,555 | B2 | 9/2011 | Hyde et al. | |
| 8,249,291 | B2 | 8/2012 | Hyde | |
| 9,445,201 | B2 | 9/2016 | Hyde et al. | |
| 2015/0139478 | A1 * | 5/2015 | Hyde | H04R 9/00 381/401 |
| 2015/0271605 | A1 * | 9/2015 | Zhang | H04R 9/043 381/401 |

* cited by examiner

*Primary Examiner* — Ahmad F. Matar
*Assistant Examiner* — Sabrina Diaz
(74) *Attorney, Agent, or Firm* — Brooks Kushman P.C.

(57) ABSTRACT

An electromagnetic transducer includes a diaphragm movable relative to a central axis, a magnetic assembly axially spaced from the diaphragm, and a magnetic gap annularly disposed about the central axis. A voice coil is coupled to the diaphragm and includes spaced first and second coil portions which are at least partially disposed in the magnetic gap. A housing includes a rear frame surrounding and supporting the magnetic assembly, the rear frame having an annular well portion in fluid communication with the magnetic gap. At least one channel is formed in the rear frame in fluid communication with the well portion and extends outwardly beyond the well portion in a radial direction. A vent is provided on an outer surface of the rear frame in fluid communication with the at least one channel, wherein air exits the transducer via the vent to transfer heat from the transducer to the ambient environment.

20 Claims, 6 Drawing Sheets

DUAL COIL ELECTRODYNAMIC TRANSDUCER WITH CHANNELS FOR VOICE COIL COOLING

TECHNICAL FIELD

Embodiments relate to dual coil electrodynamic transducers, including inverted configurations, with at least one channel for cooling of the voice coil.

BACKGROUND

An electrodynamic transducer may be utilized as a loudspeaker or as a component in a loudspeaker system to transform electrical signals into acoustical signals. An electrodynamic transducer typically includes a frame, a magnetic motor assembly that provides a magnetic field across an air gap, a voice coil, a diaphragm, and a suspension system coupled between the outer perimeter of the diaphragm and the outer perimeter of the frame. The voice coil, supported by a former, is coupled to the diaphragm so that the electrical current that flows through the voice coil causes the voice coil to move in the air gap and also causes the diaphragm to move.

The motor assembly typically includes a magnet and associated ferromagnetic components-such as pole pieces, plates, rings, and the like arranged with cylindrical or annular symmetry about a central axis. The voice coil typically is formed by an electrically conductive wire cylindrically wound for a number of turns around the lower portion of the voice coil former, while the upper part of the voice coil former is attached to the diaphragm. The coil former and the attached voice coil are inserted into the air gap of the magnetic assembly such that the voice coil is exposed to the magnetic field established by the magnetic motor assembly. The voice coil may be connected to an audio amplifier or other source of electrical signals that are to be converted into sound waves.

In a conventional construction, the diaphragm includes a flexible or compliant material that is responsive to a vibrational input. The diaphragm is suspended by one or more supporting but compliant suspension members such that the flexible portion of the diaphragm is permitted to move. In common constructions, the suspension members may include an outer suspension member known as a surround. The surround is connected to the diaphragm's outer edge and extends outward from the diaphragm to connect the diaphragm to the frame. The supporting elements may also include an inner suspension known as a spider. The spider is typically connected to the voice coil and extends from the voice coil to a lower portion of the frame, thus connecting the voice coil to the frame. In this way, the diaphragm is mechanically referenced to the voice coil, typically by being connected directly to the former on which the voice coil is supported.

In operation, electrical signals are transmitted as an alternating current through the voice coil, and the alternating current interacts with the magnetic field in the magnetic air gap. The alternating current corresponding to electrical signals conveying audio signals actuates the voice coil to reciprocate back and forth in the air gap and, correspondingly, move the diaphragm to which the coil (or coil former) is attached. Accordingly, the reciprocating voice coil actuates the diaphragm to likewise reciprocate and, consequently, produce acoustic signals that propagate as sound waves through a suitable fluid medium such as air.

Because the material of the voice coil has an electrical resistance, some of the electrical energy flowing through the voice coil is converted to heat energy instead of sound energy. The heat emitted from the voice coil may be transferred to other operative components of the loudspeaker, such as the magnetic assembly and coil former. The generation of resistive heat is disadvantageous for several reasons. First, the conversion of electrical energy to heat energy constitutes a loss in the efficiency of the transducer in performing its intended purpose—that of converting the electrical energy to mechanical energy utilized to produce acoustic signals. Second, excessive heat may damage the components of the loudspeaker and/or degrade the adhesives often employed to attach various components together, and may even cause the loudspeaker to cease functioning.

Thus, the generation of heat limits the power handling capacity and distortion-free sound volume of loudspeakers as well as their efficiency as electro-acoustical transducers. Such problems are exacerbated when one considers that electrical resistance through a voice coil increases with increasing temperature. That is, the hotter the wire of the voice coil becomes, the higher its electrical resistance becomes and the more heat it generates.

The most common form of a loudspeaker uses a single voice coil winding in a single magnetic gap. However, loudspeaker performance may be enhanced by using a multiple coil/multiple gap design. A multi-coil transducer may include two or more separate windings axially spaced apart from each other to form two or more coils, although the same wire may be employed to form the coils. The multiple voice coils are usually electrically connected together either on the coil itself or on the outside of the loudspeaker so that the coils work together to move the diaphragm. As both coils provide forces for driving the diaphragm, the power output of the loudspeaker may be increased without significantly increasing size and mass. The most common implementation of the multiple coil loudspeaker uses two voice coils and two magnetic gaps.

Many multi-coil/multi-gap designs are able to produce more power output per transducer mass and dissipate more heat than conventional single-coil designs. For example, a dual-coil design provides more coil surface area compared with many single-coil configurations, and, thus, ostensibly is capable of dissipating a greater amount of heat at a greater rate of heat transfer.

While the multiple coil/multiple gap construction has several advantages over single gap designs including higher power handling, reduced distortion, reduced inductance, and extended frequency response, there are at least three particular disadvantages with dual coil/dual gap speakers. First, insofar as a desired advantage of the dual-coil driver is its ability to operate at a greater power output, so operating the dual-coil transducer at the higher power output concomitantly causes the dual-coil transducer to generate more heat. Hence, the improved heat dissipation inherent in the dual-coil design may be offset by the greater generation of heat. There can be problems with overheated magnets due to the compact motor and the proximity of the magnets to the heat-generating voice coils. For example, as compared to single-coil transducers, adequate heat dissipation in many dual-coil transducers, and more generally multiple-coil transducers, continues to be a problem due to the longer thermal paths that must be traversed between the heat source (primarily the voice coil) and the ambient environment.

In attempt to provide transducer cooling, the pole piece may be formed with a center vent which provides a flow path for the transfer of cooling air from outside of the transducer.

Air flow through this vent is created in response to movement of the diaphragm with the excursion of the voice coil. However, such designs do little to directly cool the transducer voice coil, as air is simply pumped straight through the pole piece out the back of the motor. In fact, in some cases, a very large center vent can reduce convective cooling in proximity of the voice coil, and therefore reducing power handling of the transducer.

In some instances, holes or slots may be formed radially within the pole piece and extend outwardly from the center vent toward the voice coil in an attempt to provide convective cooling to the voice coil. Such radial holes may be effective to cause cooling air from the center vent to flow directly against at least a portion of the voice coil, but the position and shape of these holes or slots does not efficiently pull toward the voice coil and disturbs the laminar air flow within the center vent, creating turbulence and drag. Furthermore, an acoustic problem can be created with such radial slots, as a large amount of air is forced through a small passage.

One method to attempt to more directly cool the voice coil is by forcing air through the narrow magnetic gap between the voice coil and motor at high velocity. This results in a forced air cooling of the voice coil, but then a forced air transfer of heat to the magnet parts. A method to cool the voice coil directly as well as the overall transducer is to transfer heat directly from the voice coil to the ambient air, skipping the magnet subassembly entirely. This can be accomplished by forcing air past the hot voice coil through the magnetic gap and exhausting it through vents to the ambient. However, a high velocity of air is desired in the gap, and such vents that connect directly to the magnetic gap can be quite noisy.

SUMMARY

In one embodiment, an electromagnetic transducer is provided including a diaphragm movable relative to a central axis and a magnetic assembly axially spaced from the diaphragm, the magnetic assembly having a magnetic gap annularly disposed about the central axis. A voice coil is coupled to the diaphragm, the voice coil including at least a first coil portion and a second coil portion axially spaced from each other and at least partially disposed in the magnetic gap, wherein passing an electrical signal through the voice coil causes the voice coil and diaphragm to oscillate. A housing includes a front frame surrounding the diaphragm and a rear frame surrounding and supporting the magnetic assembly, the rear frame having an annular well portion in fluid communication with the magnetic gap, wherein a cross-sectional area of the well portion is greater than a cross-sectional area of the magnetic gap. At least one channel is formed in the rear frame in fluid communication with the well portion, the at least one channel extending outwardly beyond the well portion in a radial direction. A vent is provided on an outer surface of the rear frame in fluid communication and aligned with the at least one channel, wherein air flow through the magnetic gap, the well portion and the at least one channel is generated by movement of the diaphragm, and air exits the transducer via the vent to transfer heat from the transducer to the ambient environment.

In another embodiment, an electromagnetic transducer is provided including a diaphragm movable relative to a central axis. A magnetic assembly is axially spaced from the diaphragm along the central axis and includes an inner magnetic portion and an outer magnetic portion, wherein the outer magnetic portion is coaxially disposed about the central axis and radially spaced from the inner magnetic portion, and wherein an annular magnetic gap is defined between the inner and outer magnetic portions. A voice coil is coupled to the diaphragm, the voice coil including at least a first coil portion and a second coil portion axially spaced from each other and at least partially disposed in the magnetic gap, wherein passing an electrical signal through the voice coil causes the voice coil and diaphragm to oscillate. A housing includes a front frame surrounding the diaphragm and a rear frame surrounding and supporting the magnetic assembly, the rear frame having an annular well portion in fluid communication with the magnetic gap, wherein a cross-sectional area of the well portion is greater than a cross-sectional area of the magnetic gap. At least two channels are formed in the rear frame in fluid communication with the well portion, the at least two channels each extending outwardly beyond the well portion in a radial direction. A vent is provided on an outer surface of the rear frame in fluid communication and aligned with each of the at least two channels, wherein air flow through the magnetic gap, the well portion and the at least two channels is generated by movement of the diaphragm, and air exits the transducer via the vents to transfer heat from the transducer to the ambient environment.

In another embodiment, an electromagnetic transducer is provided including a diaphragm movable relative to a central axis and a magnetic assembly positioned forward of the diaphragm, the magnetic assembly having a magnetic gap annularly disposed about the central axis. A voice coil is coupled to the diaphragm, the voice coil including at least a first coil portion and a second coil portion axially spaced from each other and at least partially disposed in the magnetic gap, wherein passing an electrical signal through the voice coil causes the voice coil and diaphragm to oscillate. A housing includes a rear frame surrounding the diaphragm and a front frame surrounding and supporting the magnetic assembly, the front frame having an annular well portion in fluid communication with the magnetic gap, wherein a cross-sectional area of the well portion is greater than a cross-sectional area of the magnetic gap. At least one channel is formed in the front frame in fluid communication with the well portion, the at least one channel extending outwardly beyond the well portion in a radial direction. A vent is provided on an outer surface of the front frame in fluid communication and aligned with the at least one channel, wherein air flow through the magnetic gap, the well portion and the at least one channel is generated by movement of the diaphragm, and air exits the transducer via the vent to transfer heat from the transducer to the ambient environment.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

In embodiments disclosed herein, cooling of the voice coil is accomplished by one or more channels provided within the transducer housing to carry air from the voice coil to the ambient environment. The channels are not provided along the length of the magnetic gap itself, such that high velocity air is maintained past the hot voice coil for optimal cooling. Instead, the channels increase the cross-sectional area from the magnetic gap to the ambient environment in a controlled manner to slow down air speed and reduce noise.

In a conventional speaker, after being forced through the magnetic gap at high velocity, the air passes into the annular well portion of the rear housing. Since the well portion has a larger cross section than the magnetic gap, the air velocity slows down. However, the well portion is still narrow enough that simply adding vents at the outside of the housing would result in inadequate vent area. Therefore, in the disclosed embodiments, at least one channel is created in fluid communication with the well portion area, where the channel which extends outwardly beyond the well portion in a radial direction and routes hot air to at least one corresponding exterior vent provided on an outer surface of the housing.

Figure 1:
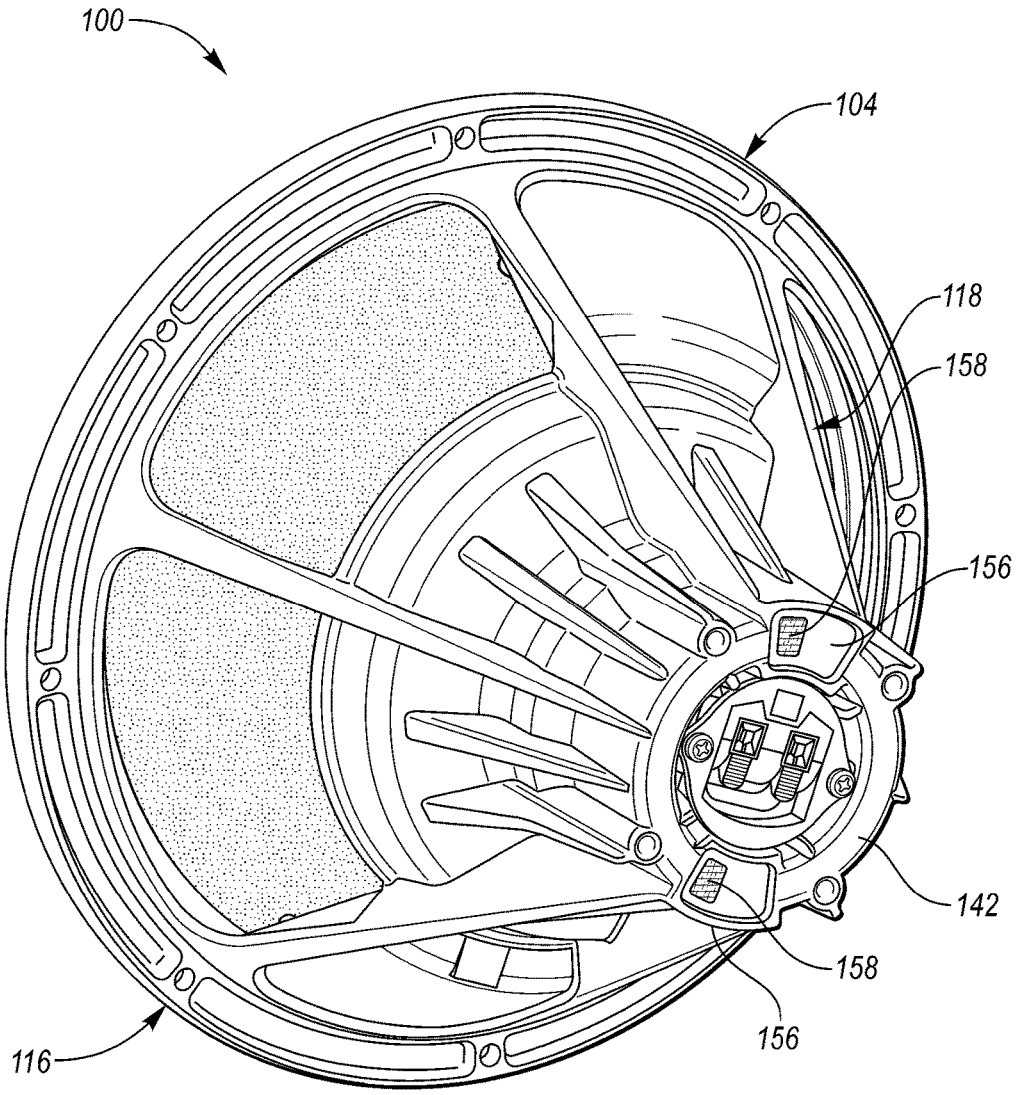
FIG. 1 is a rear perspective view of a dual coil electrodynamic transducer with cooling channels according to one embodiment.
Figure 2:
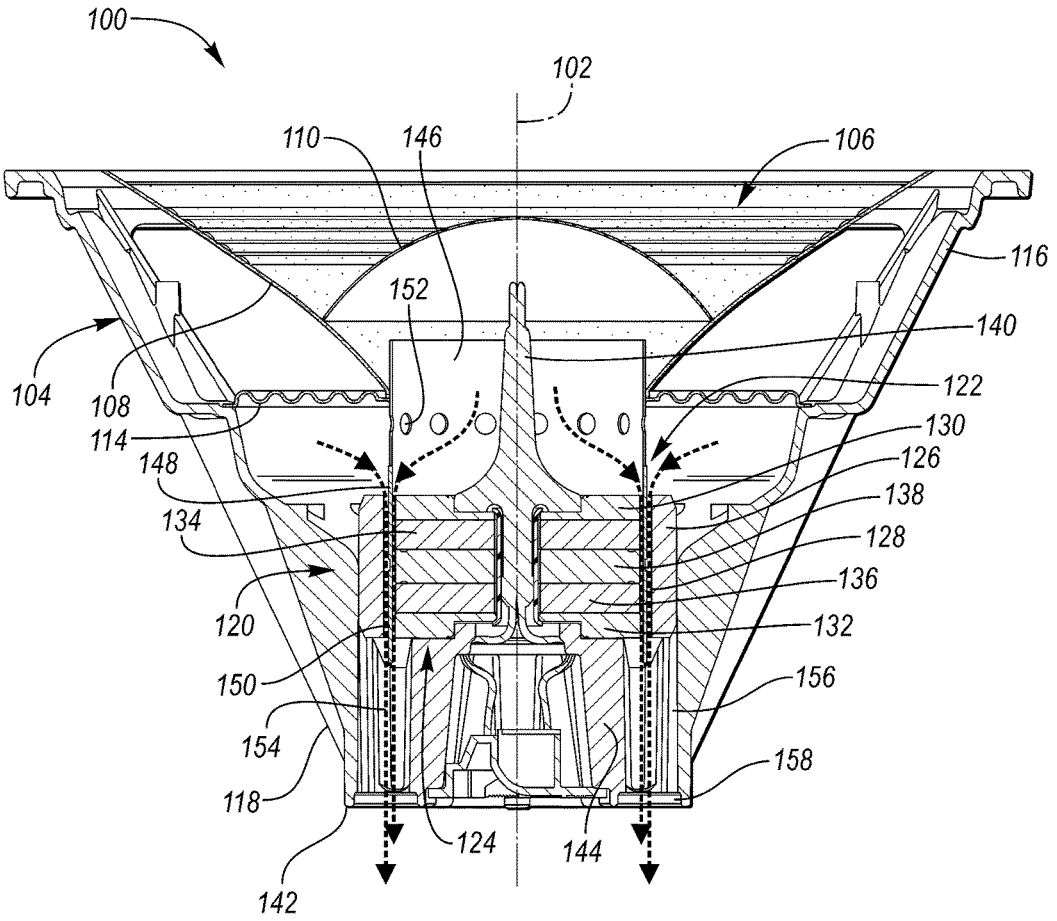
FIG. 2 is a cross-sectional view of the transducer of FIG. 1.
Figure 3:
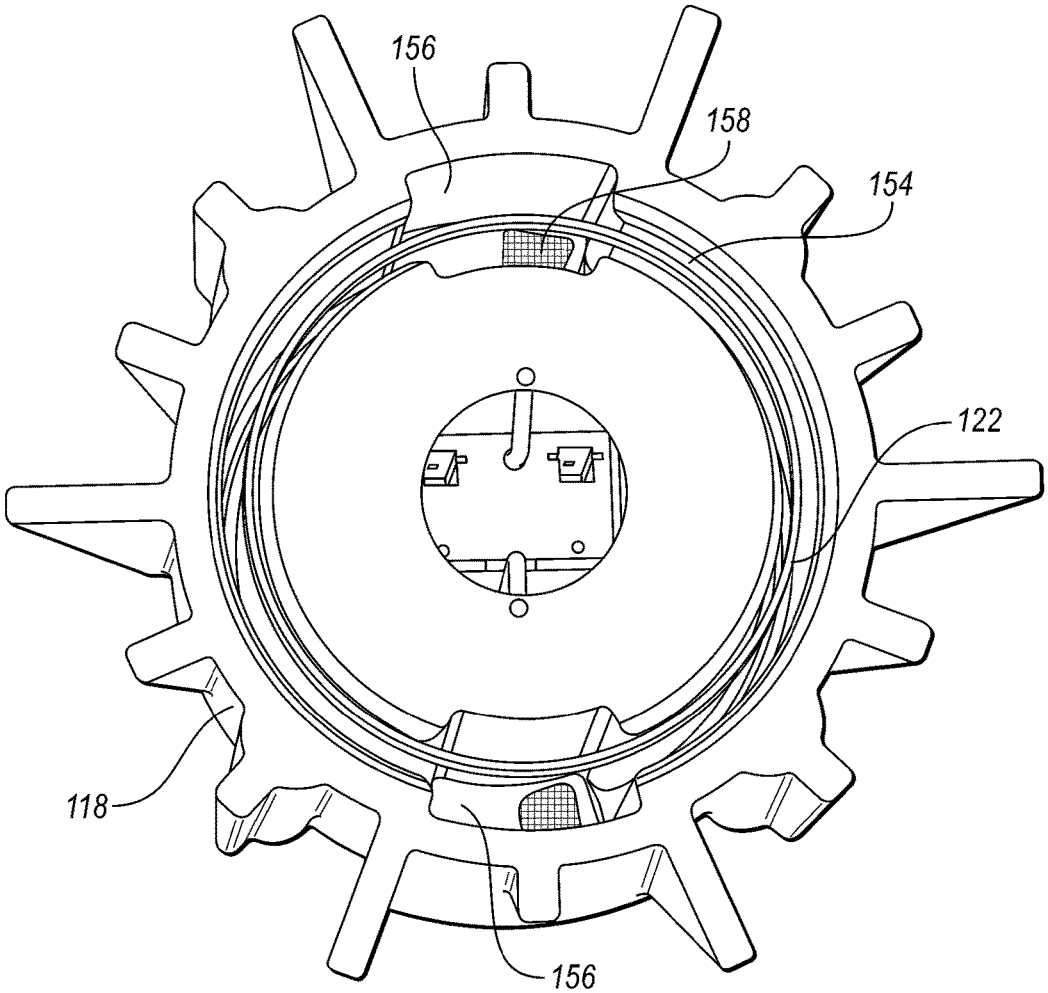
FIG. 3 is a cross-sectional view of the rear frame of the transducer of FIG. 1.

Referring first to FIGS. 1-3, a loudspeaker or electrodynamic transducer 100 is depicted. The transducer 100 is generally disposed about a central, longitudinal axis 102. The transducer 100 includes a housing 104, which may be composed of any suitably stiff, anti-vibrational material such as, for example, metal, plastic, or other material known in the art for use with loudspeaker frames. The space external to the housing 104, and more generally external to the transducer 100, will be referred to as the ambient environment.

The transducer 100 includes a diaphragm 106 that spans the open front end of the housing 104. The diaphragm 106 may be any device that may be attached to or suspended by the housing 104 or other portion of the transducer 100 in a manner that secures the diaphragm 106 while permitting at least a portion of the diaphragm 106 to move axially—i.e., along the direction of the central axis 102—in a reciprocating or oscillating manner. In the embodiment depicted, the diaphragm 106 includes a cone 108 that serves as an axially movable member, and a dome 110 that may serve as a dust cover as well as an axially movable member. The cone 108 and dome 110 may be constructed from any suitably stiff, well-damped material, such as paper. The cone 108 is coupled to the housing 104 through one or more suspension members such as a surround (not shown) and a spider 114, either or both of which may be annular. The surround and spider 114 may be affixed to the housing 104 by any suitable means. The surround and spider 114 may be any devices that provide a mechanical interconnection between the diaphragm 106 and the housing 104, and allow the diaphragm 106 to move axially relative to the housing 104 while supporting the position of the diaphragm 106 radially relative to the housing 104. For this purpose, the surround and spider 114 may be constructed from flexible, fatigue-resistant materials.

The housing 104 generally includes a front frame 116 and a rear frame 118. The front frame 116 surrounds the diaphragm 106. The rear frame 118 surrounds and supports several internal components of the transducer 100, including a magnetic assembly described in detail below.

In the embodiment illustrated in FIG. 2, the transducer 100 may be considered as having a dual coil configuration. A magnetic assembly 120 is generally disposed in and supported by the rear frame 118 of the housing 104. The magnetic assembly 120 may be any device suitable for providing a permanent magnetic field with which a voice coil 122 may be electro-dynamically coupled. The magnetic assembly 120 and voice coil 122 are axially spaced from the diaphragm 106. In the illustrated embodiment, the magnetic assembly 120 includes an inner magnetic portion 124 and an outer magnetic portion 126. The outer magnetic portion 126 is constructed from a ferromagnetic material and is generally coaxially disposed about the central axis 102 and may be in the form of a ring or annulus. The outer magnetic portion 126 may be referred to as, or considered as including, a gap sleeve or outer ring. The outer magnetic portion 126 is radially spaced from the inner magnetic portion 124 such that the inner magnetic portion 124 and outer magnetic portion 126 cooperatively define a magnetic air gap 128 between these two components, where the magnetic gap 128 is annularly disposed about the central axis 102.

In operation, the magnetic gap 128 is immersed in the permanent magnetic field established by the magnetic assembly 120. The inner magnetic portion 124 may include a stacked arrangement of ferromagnetic components that may have any suitable configuration such as plates, disks, or the like. In the illustrated example, the inner magnetic portion 124 includes a first pole piece 130, a second pole piece 132 axially spaced from the first pole piece 130, a first magnet 134 axially interposed between the first and second pole pieces 130, 132, a second magnet 136 axially interposed between the first and second pole pieces 130, 132 and axially spaced from the first magnet 134, and a spacer 138 axially interposed between the first and second magnets 134, 136, all constructed with an annular shape. The first magnet 134 is therefore interposed between the first pole piece 130 and the spacer 138, and the second magnet 136 is interposed between the second pole piece 132 and the spacer 138. The magnets 134, 136 may be composed of any permanent magnetic material, and the spacer 138 and pole pieces 130, 132 may be composed of any material capable of carrying magnetic flux. Persons skilled in the art will recognize that other configurations of magnets, spacers and pole pieces may alternatively be utilized.

The magnetic assembly 120 may be secured within the housing 104 by any suitable means. In the embodiment illustrated in FIG. 2, the outer magnetic portion 126 abuts an inside surface of the rear frame 118. The lower side of the inner magnetic portion 124 abuts another inside surface of the rear frame 118, and the upper side of the inner magnetic portion 308 abuts a centrally located support member 140. The rear frame 118 may include an inverted cup-shaped end portion or pedestal 142 having a base section 144 that supports the magnetic assembly 120.

The voice coil 122 is constructed from an elongated conductive element, such as a wire, that is wound about the central axis 102 in a generally cylindrical or helical manner. The voice coil 122 is mechanically coupled to the diaphragm 106 by any suitable means that enables the oscillating voice coil 122 to consequently actuate or drive the diaphragm 106 in an oscillating manner, thus producing mechanical sound energy correlating to the electrical signals transmitted through the voice coil 122. In the illustrated embodiment, the voice coil 122 is mechanically coupled to the diaphragm 106 through a coil support structure or member such as a coil former 146. The coil former 146 may be cylindrical as shown, and may be composed of a stiff, thermally resistant material such as, for example, a suitable plastic. The coil former 146 also functions to support the voice coil 122. The diameter of the coil former 146 is greater than the outside diameter of the inner magnetic portion 124 and less than the inside diameter of the outer magnetic portion 126, enabling the coil former 146 to extend into, and be free to move axially through, the magnetic gap 128 between the inner magnetic portion 124 and outer magnetic portion 126. At least a portion of the voice coil 122 is wound or wrapped on the outer surface of coil former 146 and may be securely attached to the coil former 146, such as by an adhesive. The voice coil 122 may be positioned on the coil former 146 such that at any given time during operation of the transducer 100, at least a portion of the voice coil 122 is disposed in the magnetic gap 128. In operation, the coil former 146 oscillates with the voice coil 122 and the oscillations are translated to the diaphragm 106.

The voice coil 122 may be formed so as to include a plurality of distinct coil portions, such that the voice coil 122 in effect constitutes a plurality of individual coils. In the embodiment illustrated in FIG. 2, the wire of the voice coil 122 is wound around the coil former 146 for a desired number of turns to form a first, upper coil portion 148, then runs down the side of the coil former 146 for an axial distance, and then is wound around the coil former 146 for a desired number of turns to form a second, lower coil portion 150 that is axially spaced from the first coil portion 148. The portion of the wire extending between the first coil portion 148 and the second coil portion 150 may be insulated to electrically isolate this portion of the wire from the first and second coil portions 148, 150. The two ends of the wire may be connected to any suitable circuitry (including, for example, an amplifier) for driving the transducer 100. The first coil portion 148 and the second coil portion 150 may be positioned on the coil former 146 such that at any given time during operation of the transducer 100, at least a portion of the first coil portion 148 and at least a portion of the second coil portion 150 are disposed in the magnetic gap 128. The first coil portion 148 may be positioned such that it is generally aligned with (i.e., adjacent to) the first pole piece 130, and the second coil portion 150 may be positioned such that it is generally aligned with (i.e., adjacent to) the second pole piece 132. By this configuration, the magnetic gap 128 may be considered as including a first magnetic gap in which the first coil portion 148 extends between the first pole piece 130 and the outer magnetic portion 126, and a second magnetic gap in which the second coil portion 150 extends between the second pole piece 132 and the outer magnetic portion 126. In some implementations, the coil former 146 may include one or more radially arranged apertures 152.

In operation, the transducer 100 receives an input of electrical signals at an appropriate connection to the voice coil 122 which causes the voice coil 122 and diaphragm 106 to oscillate. As such, electrical signals are converted into acoustic signals, and the acoustic signals propagate or radiate from the vibrating diaphragm 106 to the ambient environment. In addition, the vibrating diaphragm 106 establishes air flow in the interior space of the transducer 100, as the downward axial movement of the diaphragm 106 pushes air generally axially toward the magnetic assembly 120 and voice coil 122.

In the disclosed embodiments, one or more heat-transferring air paths are defined through the transducer 100. Each air path is generally axially oriented, meaning that each air path predominantly runs through the transducer 100 in a direction generally parallel with the central axis 102. As shown in FIGS. 2 and 3, the rear frame 118 has an annular well portion 154 as is known in the art, wherein the well portion 154 is in fluid communication with the magnetic gap 128 and a cross-sectional area of the well portion 154 is greater than a cross-sectional area of the magnetic gap 128. At least one channel 156 is formed in the rear frame 118 in fluid communication with the well portion 154, where the channels 156 extend outwardly beyond the well portion 154 in a radial direction. The channels 156 may radially span the interior and exterior regions of the magnetic gap 128 with respect to the position of the voice coil 122 in order to vent both areas.

A vent 158 is provided on an outer surface of the rear frame 118, such as through the pedestal 142, in fluid communication with and aligned with each channel 156. The channels 156 are in close enough proximity to the voice coil 122 and magnetic assembly 120 to be in good thermal contact with, and consequently carry heat away from, the voice coil 122 and magnetic assembly 120. In operation, air flow through the magnetic gap 128, the well portion 154 and the channels 156 is generated by movement of the diaphragm 106, and air exits the transducer 100 via the vents 158 to transfer heat from the transducer 100 to the ambient environment.

While the embodiment of FIGS. 1-3 uses two channels 156, which may be diametrically opposed as shown, other implementations may include less or more than two channels 156. Although no specific limitations are placed on the dimensions of the channels 156 or vents 158 (e.g., length, shape, cross-sectional area), certain factors may be considered in the sizing of the channels 156 and vents 158. For instance, channels 156 and vents 158 that are too small in cross-section may result in excessive air noise. Also, channels 156 and vents 158 that are too large in cross-section or length may not adequately exchange heat with the ambient environment. In one embodiment, the path length of each channel 156 may be approximately 5 cm, but is not limited to this length.

In one embodiment, the channel 156 has a substantially similar cross-sectional area as the vent 158, and the cross-sectional area of the channel 156 may remain relatively constant along its length. As such, a path length between the magnetic gap 128 and the vent 158 may be provided where the cross-sectional area for air flow does not change radically. The constant cross-section and adequate size of the disclosed channel air flow path prevents turbulent and noisy airflow and results in very quiet venting of air. Any noise generated internally by high air velocity in the magnetic gap 128 is sufficiently contained internally within the transducer 100 to prevent that noise from reaching the ambient.

The chart below shows a non-limiting example of cross-sectional area and average air velocity in the various parts of a transducer according to the disclosed embodiments assuming an average volume velocity based on a 1-inch P-P excursion at 40 Hz:

| Location<br>Units | Area<br>$cm^2$ | Average Air Velocity<br>m/s |
|---|---|---|
| In the magnetic gap | 5.2 | 3.7 |
| In the well portion - axial | 10 | 2.0 |
| Well to channel transition - circumferential | 6.1 | 3.2 |
| Channel and vent - axial | 7.1 | 2.8 |

Figure 4:
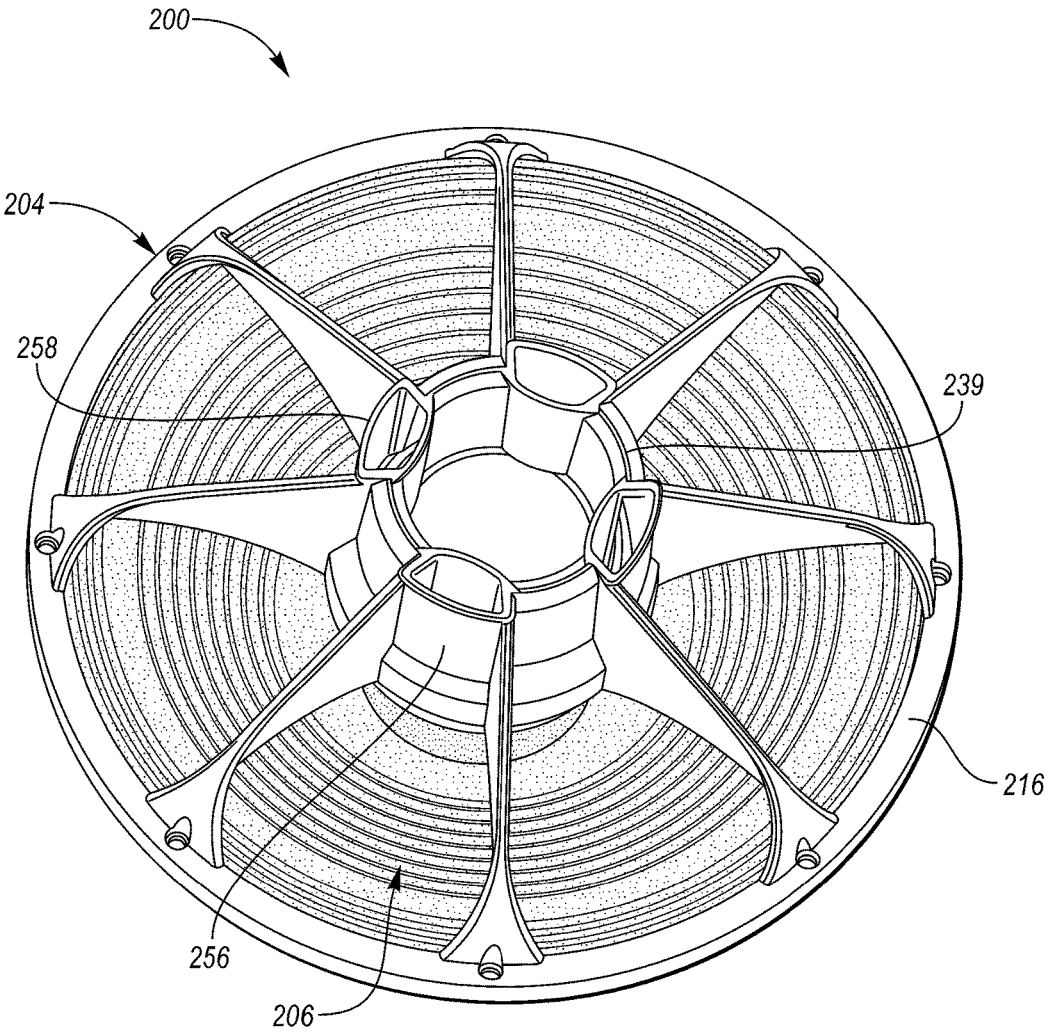
FIG. 4 is a rear perspective view of an inverted dual coil electrodynamic transducer with cooling channels according to another embodiment.
Figure 5:
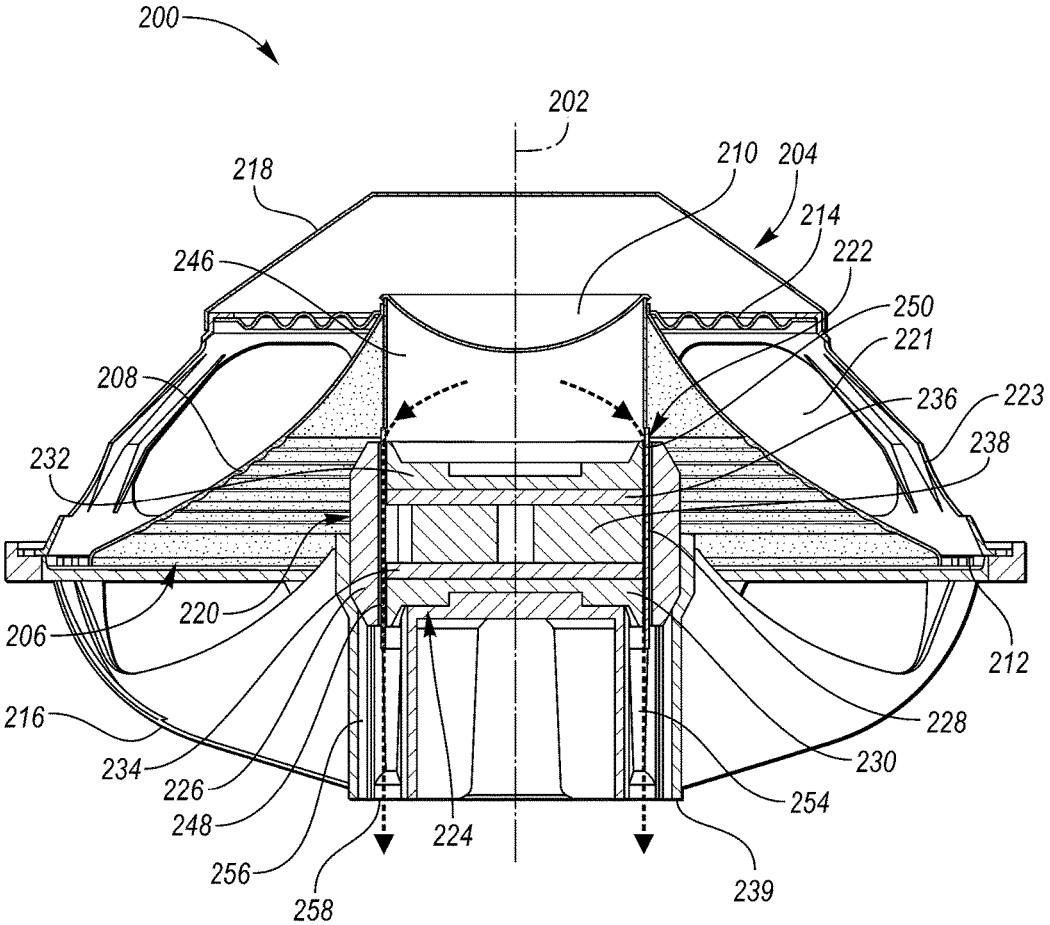
FIG. 5 is a cross-sectional view of the transducer of FIG. 4.
Figure 6:
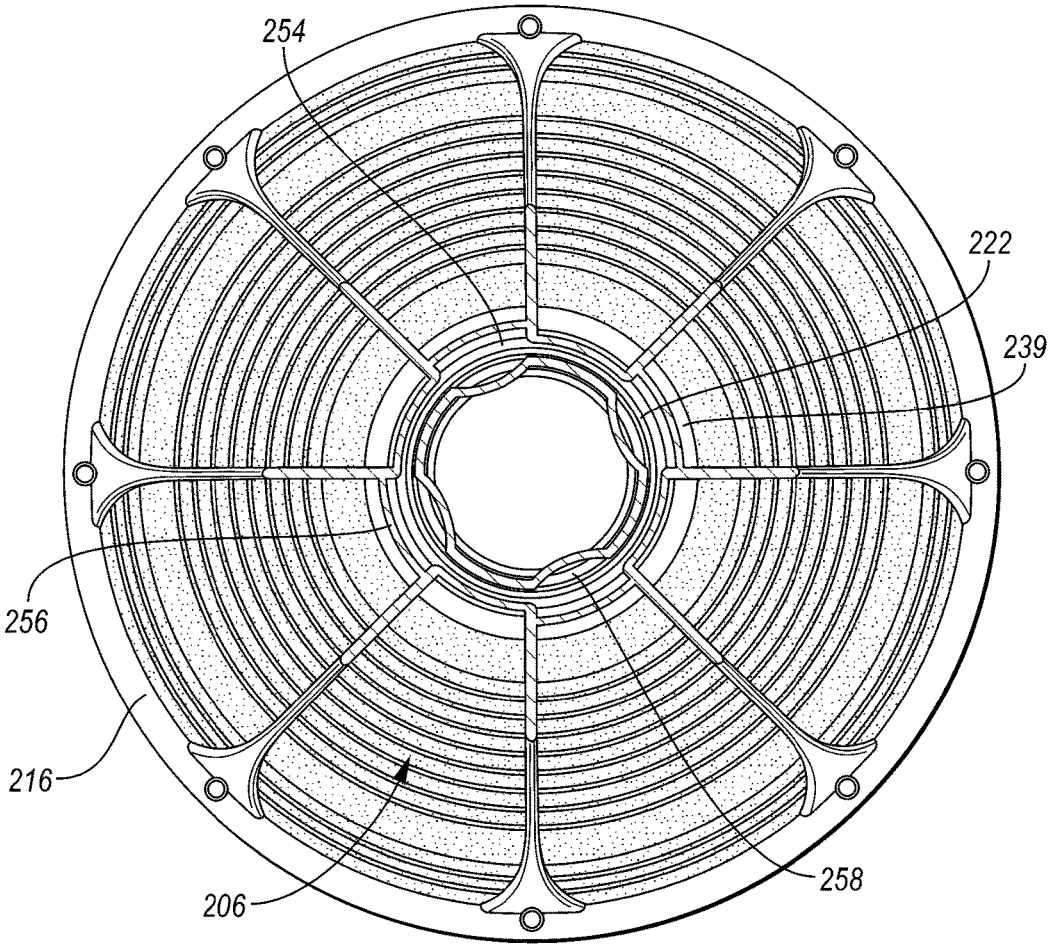
FIG. 6 is a cross-sectional view of the front frame of the transducer of FIG. 4.

FIGS. 4-6 illustrate a second embodiment of an electromagnetic transducer 200 which has an inverted dual coil configuration. Elements of transducer 200 which correspond to elements of transducer 100 are designated with similar reference numerals except for the substitution of a "2" prefix. Furthermore, it is understood that the disclosure and elements described above with respect to transducer 100 may be equally applicable to transducer 200, and vice versa.

The transducer 200 is generally disposed about a central, longitudinal axis 202. The transducer 200 includes a housing 204, and includes a diaphragm 206 disposed in a rear portion of the housing 204. In the embodiment depicted, the diaphragm 206 includes a cone 208 that serves as an axially movable member, and a dome 210 that may serve as a dust cover as well as an axially movable member. The cone 208 is coupled to the housing 204 through one or more suspension members such as a surround 212 and a spider 214, either or both of which may be annular. The surround 212 and spider 214 may be affixed to the housing 204 by any suitable means. The surround 212 and spider 214 may be any devices that provide a mechanical interconnection between the diaphragm 206 and the housing 204, and allow the diaphragm 206 to move axially relative to the housing 204 while supporting the position of the diaphragm 206 radially relative to the housing 204.

The housing 204 generally includes a front frame 216 and a rear frame 218. The rear frame 218 surrounds the diaphragm 206. The front frame 216 surrounds and supports several internal components of the transducer 200, including a magnetic assembly 220. One or more cut-outs 221 may be formed in the rear frame 118 to define a series of struts 223.

In the embodiment illustrated in FIG. 5, the transducer 200 may be considered as having an inverted dual coil configuration. A magnetic assembly 220 is generally disposed in and supported by the front frame 216 of the housing 204. The magnetic assembly 220 and a voice coil 222 are axially spaced from and positioned forward of the diaphragm 206. In the illustrated embodiment, the magnetic assembly 220 includes an inner magnetic portion 224 and an outer magnetic portion 226. The outer magnetic portion 226 is generally coaxially disposed about the central axis 202 and may be in the form of a ring or annulus. The outer magnetic portion 226 may be referred to as, or considered as including, a gap sleeve or outer ring. The outer magnetic portion 226 is radially spaced from the inner magnetic portion 224 such that the inner magnetic portion 224 and outer magnetic portion 226 cooperatively define a magnetic air gap 228 between these two components, where the magnetic gap 228 is annularly disposed about the central axis 202.

In operation, the magnetic gap 228 is immersed in the permanent magnetic field established by the magnetic assembly 220. The inner magnetic portion 224 may include a stacked arrangement of ferromagnetic components that may have any suitable configuration such as plates, disks, or the like. In the illustrated example, the inner magnetic portion 224 includes a first pole piece 230, a second pole piece 232 axially spaced from the first pole piece 230, a first magnet 234 axially interposed between the first and second pole pieces 230, 232, a second magnet 236 axially interposed between the first and second pole pieces 230, 232 and axially spaced from the first magnet 234, and a spacer 238 axially interposed between the first and second magnets 234, 236, all constructed with an annular shape. The first magnet 234 is therefore interposed between the first pole piece 230 and the spacer 238, and the second magnet 236 is interposed between the second pole piece 232 and the spacer 238. Persons skilled in the art will recognize that other configurations of magnets, spacers and pole pieces may alternatively be utilized.

The magnetic assembly 220 may be secured within the housing 204 by any suitable means. In the embodiment illustrated in FIG. 5, the front frame includes a center hub 239 disposed about the central axis 202, and the magnetic assembly 220 is coupled to the center hub 239.

The voice coil 222 is constructed from an elongated conductive element, such as a wire, that is wound about the central axis 202 in a generally cylindrical or helical manner. The voice coil 222 is mechanically coupled to the diaphragm 206 by any suitable means that enables the oscillating voice coil 222 to consequently actuate or drive the diaphragm 206 in an oscillating manner, thus producing mechanical sound energy correlating to the electrical signals transmitted through the voice coil 222. In the illustrated embodiment, the voice coil 222 is mechanically coupled to the diaphragm 206 through a coil support structure or member such as a coil former 246. The coil former 246 also functions to support the voice coil 222. The diameter of the coil former 246 is greater than the outside diameter of the inner magnetic portion 224 and less than the inside diameter of the outer magnetic portion 226, enabling the coil former 246 to extend into, and be free to move axially through, the magnetic gap 228 between the inner magnetic portion 224 and outer magnetic portion 226. At least a portion of the voice coil 222 is wound or wrapped on the outer surface of coil former 246 and may be securely attached to the coil former 226, such as by an adhesive. The voice coil 222 may be positioned on the coil former 246 such that at any given time during operation of the transducer 200, at least a portion of the voice coil 222 is disposed in the magnetic gap 228. In operation, the coil former 246 oscillates with the voice coil 222 and the oscillations are translated to the diaphragm 206.

The voice coil 222 may be formed so as to include a plurality of distinct coil portions, such that the voice coil 222 in effect constitutes a plurality of individual coils. In the embodiment illustrated in FIG. 5, the wire of the voice coil 222 is wound around the coil former 246 for a desired number of turns to form a first, upper coil portion 248, then runs down the side of the coil former 246 for an axial distance, and then is wound around the coil former 246 for a desired number of turns to form a second, lower coil portion 250 that is axially spaced from the first coil portion 248. The portion of the wire extending between the first coil portion 248 and the second coil portion 250 may be insulated to electrically isolate this portion of the wire from the first and second coil portions 248, 250. The two ends of the wire may be connected to any suitable circuitry (including, for example, an amplifier) for driving the transducer 200. The first coil portion 248 and the second coil portion 250 may be positioned on the coil former 246 such that at any given time during operation of the transducer 200, at least a portion of the first coil portion 248 and at least a portion of the second coil portion 250 are disposed in the magnetic gap 228. The first coil portion 248 may be positioned such that it is generally aligned with (i.e., adjacent to) the first pole piece 230, and the second coil portion 250 may be positioned such that it is generally aligned with (i.e., adjacent to) the second pole piece 232. By this configuration, the magnetic gap 228 may be considered as including a first magnetic gap in which the first coil portion 248 extends between the first pole piece 230 and the outer magnetic portion 226, and a second magnetic gap in which the second coil portion 250 extends between the second pole piece 232 and the outer magnetic portion 226. In some implementations, the coil former 246 may further include one or more radially arranged apertures (not shown).

In operation, the transducer 200 receives an input of electrical signals at an appropriate connection to the voice coil 222 which causes the voice coil 222 and diaphragm 206 to oscillate. As such, electrical signals are converted into acoustic signals, and the acoustic signals propagate or radiate from the vibrating diaphragm 206 to the ambient environment. In addition, the vibrating diaphragm 206 establishes air flow in the interior space of the transducer 200, as the downward axial movement of the diaphragm 206 pushes air generally axially toward the magnetic assembly 220 and voice coil 222.

In the disclosed embodiments, one or more heat-transferring air paths are defined through the transducer 200. Each air path is generally axially oriented, meaning that each air path predominantly runs through the transducer 200 in a direction generally parallel with the central axis 102. As shown in FIGS. 5 and 6, the front frame 216 has an annular well portion 254 as is known in the art, wherein the well portion 254 is in fluid communication with the magnetic gap 228 and a cross-sectional area of the well portion 254 is greater than a cross-sectional area of the magnetic gap 228. At least one channel 256 is formed in the front frame 216 in fluid communication with the well portion 254, where the channels 256 extend outwardly beyond the well portion 254 in a radial direction. The channels 256 may radially span the interior and exterior regions of the magnetic gap 228 with respect to the position of the voice coil 222 in order to vent both areas.

A vent 258 is provided on an outer surface of the front frame 216, such as through the center hub structure 239, in fluid communication with and aligned with each channel 256. The channels 256 are in close enough proximity to the voice coil 222 and magnetic assembly 220 to be in good thermal contact with, and consequently carry heat away from, the voice coil 222 and magnetic assembly 220. In operation, air flow through the magnetic gap 228, the well portion 254 and the channels 256 is generated by movement of the diaphragm 206, and air exits the transducer 200 via the vents 258 to transfer heat from the transducer 200 to the ambient environment.

While the embodiment of FIGS. 4-6 uses four channels 256, which may be equidistantly spaced as shown, other implementations may include less or more than four channels 156. Although no specific limitations are placed on the dimensions of the channels 256 or vents 258 (e.g., length, shape, cross-sectional area), certain factors may be considered in the sizing of the channels 256 and vents 258. For instance, channels 256 and vents 258 that are too small in cross-section may result in excessive air noise. Also, channels 256 and vents 258 that are too large in cross-section or length may not adequately exchange heat with the ambient environment. In one embodiment, the path length of each channel 256 may be approximately 5 cm, but is not limited to this length.

In one embodiment, the channel 256 has a substantially similar cross-sectional area as the vent 258, and the cross-sectional area of the channel 256 may remain relatively constant along its length. As such, a path length between the magnetic gap 228 and the vent 258 may be provided where the cross-sectional area for air flow does not change radically. The constant cross-section and adequate size of the disclosed channel air flow path prevents turbulent and noisy airflow and results in very quiet venting of air. Any noise generated internally by high air velocity in the magnetic gap 228 is sufficiently contained internally within the transducer 200 to prevent that noise from reaching the ambient. As such, in both of the transducers 100, 200 described herein, the channels 156, 256 increase the cross-sectional area from the magnetic gap 128, 228 to the ambient environment in a controlled manner to slow down air speed and reduce noise while providing efficient and effective cooling of the voice coil 122, 222 and magnetic assembly 120, 220.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An electromagnetic transducer, comprising:
a diaphragm movable relative to a central axis;
a magnetic assembly axially spaced from the diaphragm, the magnetic assembly having a magnetic gap annularly disposed about the central axis;
a voice coil coupled to the diaphragm, the voice coil including at least a first coil portion and a second coil portion axially spaced from each other and at least partially disposed in the magnetic gap, wherein passing an electrical signal through the voice coil causes the voice coil and diaphragm to oscillate;
a housing having a front frame surrounding the diaphragm and a rear frame surrounding and supporting the magnetic assembly, the rear frame having an annular well portion in fluid communication with the magnetic gap, wherein a cross-sectional area of the well portion is greater than a cross-sectional area of the magnetic gap;
at least one channel formed in an axial direction in the rear frame in fluid communication with the well portion, the at least one channel extending outwardly beyond the well portion in a radial direction; and
a vent provided on an outer surface of the rear frame in fluid communication and aligned with the at least one channel,
wherein air flow through the magnetic gap, the well portion and the at least one channel is generated by movement of the diaphragm, and air exits the transducer via the vent to transfer heat from the transducer to the ambient environment.

2. The transducer of claim 1, wherein the at least one channel includes two channels which are diametrically opposed.

3. The transducer of claim 1, wherein the at least one channel and the vent have substantially similar cross-sectional areas.

4. The transducer of claim 1, wherein the at least one channel has a generally uniform cross-sectional area along its length.

5. The transducer of claim 1, further including a coil former disposed in the magnetic gap, wherein the first and second coil portions and the diaphragm are attached to coil former such that the voice coil is coupled to the diaphragm via the coil former.

6. The transducer of claim 5, wherein the former includes one or more apertures.

7. The transducer of claim 1, wherein the magnetic assembly includes a first pole piece, a second pole piece axially spaced from the first pole piece, a first magnet axially interposed between the first and second pole pieces, a second magnet axially interposed between the first and second pole pieces and axially spaced from the first magnet, and a spacer axially interposed between the first and second magnets.

8. The transducer of claim 1, wherein the magnetic assembly includes an inner magnetic portion and an outer magnetic portion, wherein the outer magnetic portion is coaxially disposed about the central axis and radially spaced from the inner magnetic portion, and wherein the magnetic gap is defined between the inner and outer magnetic portions.

9. The transducer of claim 1, further including a surround coupled between the diaphragm and the housing, and a spider coupled between the voice coil and the housing.

10. An electromagnetic transducer, comprising:

a diaphragm movable relative to a central axis;

a magnetic assembly axially spaced from the diaphragm along the central axis and including an inner magnetic portion and an outer magnetic portion, wherein the outer magnetic portion is coaxially disposed about the central axis and radially spaced from the inner magnetic portion, and wherein an annular magnetic gap is defined between the inner and outer magnetic portions;

a voice coil coupled to the diaphragm, the voice coil including at least a first coil portion and a second coil portion axially spaced from each other and at least partially disposed in the magnetic gap, wherein passing an electrical signal through the voice coil causes the voice coil and diaphragm to oscillate;

a housing having a front frame surrounding the diaphragm and a rear frame surrounding and supporting the magnetic assembly, the rear frame having an annular well portion in fluid communication with the magnetic gap, wherein a cross-sectional area of the well portion is greater than a cross-sectional area of the magnetic gap;

at least two channels formed in an axial direction in the rear frame in fluid communication with the well portion, the at least two channels each extending outwardly beyond the well portion in a radial direction; and a vent provided on an outer surface of the rear frame in fluid communication and aligned with each of the at least two channels, wherein air flow through the magnetic gap, the well portion and the at least two channels is generated by movement of the diaphragm, and air exits the transducer via the vents to transfer heat from the transducer to the ambient environment.

11. An electromagnetic transducer, comprising:

a diaphragm movable relative to a central axis;

a magnetic assembly positioned forward of the diaphragm, the magnetic assembly having a magnetic gap annularly disposed about the central axis;

a voice coil coupled to the diaphragm, the voice coil including at least a first coil portion and a second coil portion axially spaced from each other and at least partially disposed in the magnetic gap, wherein passing an electrical signal through the voice coil causes the voice coil and diaphragm to oscillate;

a housing having a rear frame surrounding the diaphragm and a front frame surrounding and supporting the magnetic assembly, the front frame having an annular well portion in fluid communication with the magnetic gap, wherein a cross-sectional area of the well portion is greater than a cross-sectional area of the magnetic gap;

at least one channel formed in an axial direction in the front frame in fluid communication with the well portion, the at least one channel extending outwardly beyond the well portion in a radial direction; and a vent provided on an outer surface of the front frame in fluid communication and aligned with the at least one channel, wherein air flow through the magnetic gap, the well portion and the at least one channel is generated by movement of the diaphragm, and air exits the transducer via the vent to transfer heat from the transducer to the ambient environment.

12. The transducer of claim 11, wherein the at least one channel includes four channels which are equidistantly spaced.

13. The transducer of claim 11, wherein the at least one channel and the vent have substantially similar cross-sectional areas.

14. The transducer of claim 11, wherein the at least one channel has a generally uniform cross-sectional area along its length.

15. The transducer of claim 11, further including a coil former disposed in the magnetic gap, wherein the first and second coil portions and the diaphragm are attached to coil former such that the voice coil is coupled to the diaphragm via the coil former.

16. The transducer of claim 15, wherein the former includes one or more apertures.

17. The transducer of claim 11, wherein the magnetic assembly includes a first pole piece, a second pole piece axially spaced from the first pole piece, a first magnet axially interposed between the first and second pole pieces, a second magnet axially interposed between the first and second pole pieces and axially spaced from the first magnet, and a spacer axially interposed between the first and second magnets.

18. The transducer of claim 11, wherein the magnetic assembly includes an inner magnetic portion and an outer magnetic portion, wherein the outer magnetic portion is coaxially disposed about the central axis and radially spaced from the inner magnetic portion, and wherein the magnetic gap is defined between the inner and outer magnetic portions.

19. The transducer of claim 11, further including a surround coupled between the diaphragm and the housing, and a spider coupled between the voice coil and the housing.

20. The transducer of claim 11, wherein the front frame includes a center hub disposed about the central axis, and the at least one magnetic assembly is coupled to the center hub.

* * * * *